US005104127A

United States Patent [19]

Whitney

[11] Patent Number: 5,104,127

[45] Date of Patent: Apr. 14, 1992

[54] BOARD GAME

[76] Inventor: Yvetta E. Whitney, 7447 S. Shore Dr., Apt. 4H, Chicago, Ill. 60649

[21] Appl. No.: 559,712

[22] Filed: Jul. 30, 1990

[51] Int. Cl.[5] ..... A63F 3/00

[52] U.S. Cl. ..... 273/243

[58] Field of Search ..... 273/242, 243, 250, 253, 273/248, 249

[56] References Cited

U.S. PATENT DOCUMENTS

| | | | |
|---|---|---|---|
| 1,555,909 | 10/1925 | Carson . | |
| 3,081,088 | 3/1963 | Kast . | |
| 3,926,438 | 12/1975 | Breslow et al. . | |
| 4,013,294 | 3/1977 | Smeda | 273/243 X |
| 4,124,214 | 11/1978 | Pavis . | |
| 4,159,117 | 6/1979 | Kuna | 273/243 |
| 4,216,971 | 8/1980 | Lyke | 273/243 |
| 4,279,422 | 7/1981 | Shaw . | |
| 4,359,226 | 11/1982 | Neff . | |
| 4,368,889 | 1/1983 | Reker, Jr. . | |
| 4,682,777 | 7/1987 | Wood | 273/243 |
| 4,684,135 | 8/1987 | Bouchal . | |
| 4,743,029 | 5/1988 | Consolatore | 273/243 |
| 4,815,976 | 3/1989 | Krane . | |
| 4,893,819 | 1/1990 | Wright | 273/243 |
| 4,966,371 | 10/1990 | Sherman | 273/243 |
| 4,993,717 | 2/1991 | Fiske | 273/243 |

FOREIGN PATENT DOCUMENTS

| | | | |
|---|---|---|---|
| 2203957 | 11/1988 | United Kingdom | 273/243 |
| 2206286 | 1/1989 | United Kingdom | 273/243 |
| 2215222 | 9/1989 | United Kingdom | 273/243 |

*Primary Examiner*—Edward M. Coven
*Assistant Examiner*—William E. Stoll
*Attorney, Agent, or Firm*—Mathew R. P. Perrone, Jr.

[57] ABSTRACT

A board game having a variety of spaces therearound provides an imitation of the variety and spice of life. The game includes direction cards which vary from game to game, with a few of the direction cards being required for each game. Most spaces are divided into three parts to further enhance the variety of the game. The center of board includes a space to indicate a player's success.

8 Claims, 1 Drawing Sheet

BOARD GAME

This invention relates to a board game and more particularly to a ethod and a board game utilized to reduce stress and assist each player in adding personal enjoyment to life.

BACKGROUND OF THE INVENTION

Stress is a major factor in modern times. Many efforts are made to reduce stress. It is well settled in the field of psychiatry and psychology that one of the primary methods of reducing stress is for a person to become more acquainted with oneself, and to learn how to enjoy oneself, and then to learn how to enjoy being that person. It is always desirable to simplify one or more those procedures by making a game out of one or more of them.

Many board games do exist for that purpose. However, these board games do not have a certain flexibility, and, therefore, do not provide the variety that comss with life. It is desirable therefore to have a board game that can have some flexibility much as a state of a person's life does.

SUMMARY OF THE INVENTION

Accordingly, among the many objectives of this invention is to provide a board game suitable for both imitating life and reducing stress.

A further objective of this invention is to provide a board game, which is flexible.

A still further objective of this invention is to provide a board game that reflects the different effects a single event may have on a person.

Yet a further objective is to provide a board game, which provides a variety of games without a board change.

These and other objectives of this invention are met by providing a board game having a plurality of spaces therearound which imitate the variety and spice of life and assist in the reduction of stress.

BRIEF DESCRIPTION OF THE DRAWINGS

Throughout the Figures of the drawing, where the same part appears in more than one Figure of the drawing, the same number is applied thereto.

DESCRIPTION OF THE PREFERRED EMBODIMENTS

Figure 2:
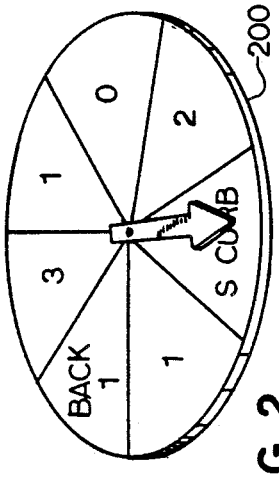
FIG. 2 illustrates a top of the spinner 200 of the stress-reducing game of this invention.

In order to get dreams or other ideas to come into being at their highest level, a mental conditioning process is desired. The game of this invention conditions one to develop his or her dream or idea to the fullest.

The game equipment includes:

one playing board—preferably about 84 centimeters (33 inches) by 56 centimeters (22 inches);

one board with a centrally mounted spinning arrow—preferably entitled "Thoughts, Action, Reactions" with seven numbered spaces on it;

a deck of 84 direction cards preferably entitled "Subconscious" Direction Cards;

at least 42 tokens for indicating a move in the game preferably called Dream/Idea tokens and preferably including two each of car, house, ice skates, diploma, judge's gavel, stethoscope, nurse's cap, computer, typewriter, book, hoe, bicycle (not shown in the drawing due to verbal description being an adequate description thereof);

six small tokens of any suitable shape and preferably of a different color preferably called "JOY" to be used when the DREAM/IDEA is written on a card or when steps in assurance are climbed; and six blank tokens preferably called "Hanker Chips" to be used until a player gets a dream or an idea, and while a player is wishing or floundering;

one package of 50 small blank cards usually about five centimeters (two inches) by 2.5 centimeters (one inch) preferably for writing special dreams or ideas on and preferably called "Ask and Receive";

one holding mechanism preferably called an "Abundance Chest" to hold tokens and "Ask and Receive" Cards; and six (6) clear fleshtone plastic human figures; for six players, with size of figures being the sameaas human figures on the playing board and preferably called "ME"; and optionally one (1) box insert such as those in musical greeting cards; and optionally six (6) small battery operated lights.

The playing board includes spaces around the edge of the board. Usually there are 35 spaces—thirty spaces preferably have a size 8.9 centimeters (3.5 inches) by 5 centimeters (2 inches) and four corners of the board having a size of about 12.7 centimeters (5 inches) by 12.7 centimeters (5 inches) around the edge of the board, with one large space approximately 24.1 centimeters (9.5 inches) by 25.4 centimeters (10 inches) in the middle of the board.

In addition to the large PEACE! GRACE! space, the center of the board includes a LET THERE BE space. The "LET THERE BE" space is approximately 7.5 centimeters by 12.5 centimeters (3 inches by 5 inches) to the right of the large space (PEACE! GRACE!) in the middle of the board. Also, the "LET THERE BE" space is resting place for the clear, plastic, human figure to rest.

Within the large space in the center of the board, that large space having the shape of a frame house, is a plurality of words indicating success for a player who reaches that area. That large space is preferably called "PEACE! GRACE!".

All of 30 spaces around the edges but S curbs have designs or pictures with a name of what they represent. Preferred names for the 30 spaces are BONDAGE, DESIRE, DECISION, POWER, LOVE, FAITH, WORK, IMAGINATION, BAD HABIT, PRAYER, LISTEN, ASSURANCE, RENUNCIATION, REST, MEDIATION, FEAST OR FAMINE, NATURE OF GOD, ZEAL, PEACE, UNDERSTANDING, ORDER, KARMA, WILL, STRENGTH, WISDOM, FORGIvE, EXPECTATION, LIFE, PERSONALIZED GIFTS, "I AM". The four corners are called "S CURBS".

Most of the 30 spaces are divided into three parts, with the largest part in the center. The top half of the space is preferably called "Voila" (to represent a positive occurrence) and the lower half of the space is preferably called "Heebie Jeebies" (to represent a negative occurrence).

The BONDAGE and ASSURANCE spaces are not so divided into three parta.

Direction cards, preferably called "SUBCONSCIOUS", approximately 5.1 centimeters (two inches) square vary the game with quotations or sayings plus written directions for the player to move the token. The direction card can be positive or negative depending on the game status and statements on the card.

The spinning arrow board called "THOUGHTS ACTIONS REACTION" has spaces that are numbered in order to indicate moves for the game. The arrow is spun once for each turn. Spaces on the board include two spaces with the numeral 1, one space with the numeral 2, one space with the numeral 3, one space with "go back 1 space", and one space with go to "S Curb", and one space with "0".

Variety for the game is created by only playing with 50 direction cards per game, with the exception of eight (8) special cards. While the eight special cards must be in every game, the other cards may be changed, because like life, the game is always different. "VOILA" (or V) on directions cards means the token is to rest on the upper level of the space the token is on. HEEBIE JEEBIES (or HJ) means the token is to rest on the lower level of the space the token is on.

A player's turn consists of (1) spinning the arrow once, (2) moving the number of spaces as indicated by arrow, (3) selecting a Direction card, and (4) following the directions—at which point the turn ends.

The tokens (Hanker Chips or Dream Idea or Joy tokens) move to the same level in the next space landed on as the token was before the turn started. Then the directions on the cards are followed.

SPECIAL SPACES ON PLAYING BOARD

If a player lands on the "LISTEN" space a player must NOT SPEAK to anyone until after the space is left. If that player speaks to anyone for any reason while on the "LISTEN", the token is moved back to bondage without a Dream/Idea.

With the KARMA and BAD HABITS space, both levels are Heebie Jeebies. A player cannot select a direction card when the player's token lands thereon until the next turn.

On the NATURE OF GOD space both levels are "VOILA". If a player lands here as a result of a direction card, and it says "lower level" and "Heebie Jeebies "HJ", those directions may be disregarded.

The LET THERE BE space is another special place on the board to receive the human, plastic figure. Thus, it the game.

With ASSURANCE, every player must climb steps and always enter this space on the bottom step. The player does not draw a direction card when landing here. Steps are climbed by one spin of the arrow each turn. The arrow tells a player how many steps to climb. There is no high or low level on this space. A player always exits Assurance and goes to the upper level of the next space landed in after leaving the top step of Assurance. As mentioned, the joy disc may be used to climb stairs.

FEAST OR FAMINE. This space is divided in half. A player takes a normal turn, if a player lands in upper half, but if a player lands in lower half, in any way for any reason, the player gives up all Dream/Ideas, gets a Hanker Chip and goes back to Bondage.

"S" CURBS. There are four (4) S Curb spaces on the board. The S curb is generally at the corner of the board. When a player lands on one of these spaces, the player loses a turn; "Stand Still". The player may choose to lose a second turn, there by turning the Stand Still into a Stepping Stone. If the player loses the second turn (by choice), the player can select a new Dream-/Idea as they leave the S Curb and before they pick up a direction card. If all players (2 to 6 players) are on S Curbs, the first one who landed on the S Curb Space moves 2 spaces forward and then spins the arrow.

If a player spins the number 3, which lands that player in the "REALIZATION" space, that player receives an extra Dream/Idea card to come true. This dream idea card is selected before the direction card.

ALTERATIONS TO PLAYING BOARD

Indentation of human figure in the first and last box on the board adds to the variety of the game.

A recess of the entire PEACE! GRACE! space is in the center of the board.

When the board requires electricity, the entire board must be set on a raised platform, so it can house the lights, batteries and music box underneath. The lights, batteries and music are clearly an optional feature of this game. The Hall Mark space in the center of the board is preferably made of a translucent or transparent material (preferably plastic), that light can filter through. The lights, batteries and music box are on the under side of the Hall Mark, and are activated to play when pressure is applied from the top. The electrical option for the game can be eliminated if desired.

PLAYING INSTRUCTIONS

The number of players can range from 2 to 6. To determine the firat player, the arrow is spun. The one to land on the highest number first is the first player. Other random selection methods may also be used to pick the order of players' moves.

The Direction cards are shuffled. Each player places a Hanker Chip on Bondage. With a spin of the Arrow, the number of spaces to move a Hanker Chip is determined. Then the correct number of spaces are moved according to arrow pointer. A Direction Card is selected from the Sub Conscious stack, the directions thereon are followed.

Plastic figures can be placed in the starting box on the board—one (1) figure for each player.

The first turn of each player is complete when the plastic figure "ME" is taken out of the first box, and moved to the last box on the board (that is the space "LET THERE BE"), and permitted to stay there.

A player only moves his or her token back to the first space if the direction cards send the player back, or the spinners (random number generator) or board tells the player to start over.

When the player's token reaches the last box, the plastic figure called "ME" (usually a flattened piece of a material in human shape) is taken and placed in the Hall Mark Space in the middle of the board; where a player can manipulate the figure in any desired way. This action activates, by means of a standard switching mechanism not shown, the lights and the music from the tape recorder if those devices are present.

LAST SPACE "LET THERE BE". The spin that brings a player to the space "LET THERE BE" can be used as a last spin, or as a means to go around the board again, by using Desires as the first space for reentry instead of the space Bondage. If the Direction card is Heebie Jeebies (or HJ), the player goes back to the first space, which has a heebie jeebies space. If the player spins a three, and lands in the "REALIZATION/LET THERE BE" space, the player gets an extra Dream-/Idea to come true. The Dream/Idea is selected before the direction card.

A master is a player who preserves his or her well being and achieved goals by being in the upper level "VOILA" after completely circling the board. These players can move to the center of the board entitled. . . "PEACE! GRACE!"; go around again because they did not achieve the goals they set out for.

The game "VOILA", like life, can be timeless. The players may also call a halt to playing in a variety of manners—for example, by setting a time limit; by setting a limit to number of obtained goals, or by calling a halt after the first player, or every player circles the board once with the best player being the first one who completes the circle, with the highest number of achievements.

For all trips around the board after the first trip, the starting point is the "DESIRE" space.

A typical example of a DREAM/IDEA that was not planned right assumes that a lady dreams of getting a new dress for a special dance, receiving just the right dress, and then becoming ill on the night of the dance, and not being able to go. That dream is a Heebie Jeebies, lower level. SHE DID NOT SEE HERSELF DANCING AT THE DANCE IN THAT DRESS! If she had, her dream would have been on the upper level or VOILA!

In this manner, there is no real end point in this game, like life itself. So each player can devise a personal endpoint, dream or goal—each time the game is played.

GAME IMPLEMENTS

Figure 1:
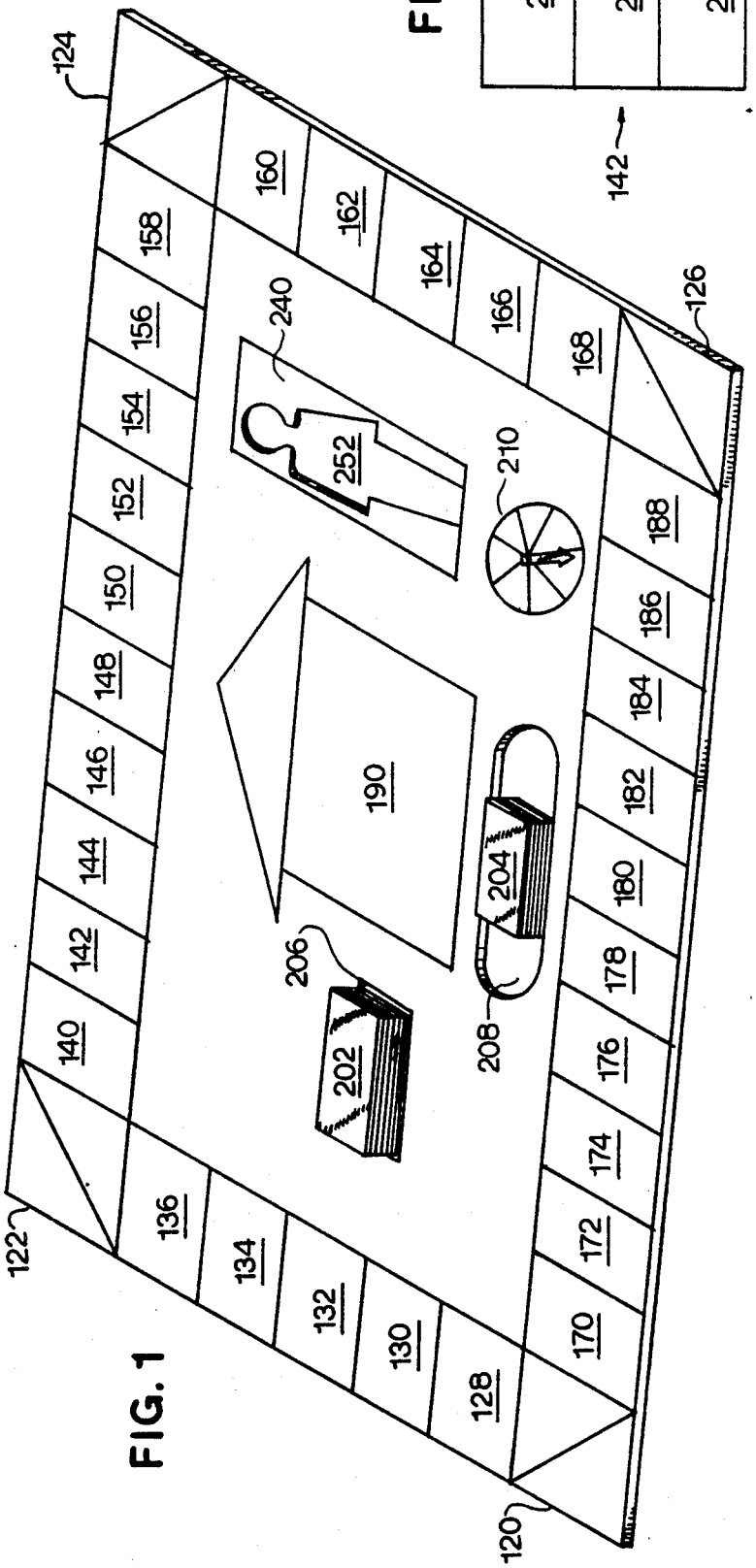
FIG. 1 illustrates a top view of the board 100 of the stress-reducing game of this invention.

Referring now to FIG. 1, a board 100 of a game is depicted. The board is generally rectangular in shape and has a first S curb 120 at one corner thereof, a second S curb 122 at a corner thereof, a third S curb 124 at a corner thereof and a fourth S curb 126 at a corner thereof.

Between first S curb 120 and second S curb 122 are the following landing spots for tokens used in the game: Forgive 128, Expectations 130, Life 132, Prosperity 134, and I Am 136. Forgive 128 is closest to first S curb 120. I Am (Personalized Gift) 136 is closest to second S curb 122. Those landing spots are preferably in that order.

Between second S curb 122 and third S curb 134 are Bondage 140, Desire 142, Decision 144, Power 146, Love 148, Faith 150, Work 152, Imagination 154, Habits 156, and Prayer 158. Those landing spots are in that order.

Between third S curb 124 and fourth S curb 126 are Listen 160, Assurance 162, Renunciation 164, Rest 166, Meditation 168 in that order proceeding from third S curb 124 to fourth S curb 126.

Between first S curb 120 and fourth S curb 126 are in order Order 170, Understanding 172, Peace 174, Zeal 176, Wisdom 178, Strength 180, Will 182, Karma 184, Nature of God 186 and Feast 188. Those landing spots are in that order.

The landing spots may be arranged in any suitable order. The preferred order is as defined.

Centrally located on the board 100 are a series of words in house-shaped block or PEACE! GRACE! 190, that a person with a good faith will benefit from in playing this game. Also situated on the board 100 are card spaces for of cards to be used in the game. A first deck of 50 cards is called ask and receive cards 202, which are generally postive in result. The ask and receive cards 202 are blank cards to be used when a player has dream or idea for which there is no token. The player writes a dream or idea on the card and uses a joy token to reprssent what is written.

A second deck of cards is called subconscious or direction cards 204, which are generally negative in result. The ask and receive cards 202 are stored for game use in abundance chest 206. The direction cards 204 are stored in second card space 208.

Each of the direction cards 204 and abundance cards 202 are numbered. Of the 84 cards available, only 42 in addition to an eight stationary card forms are used in the game. This permits each game to be flexible as according to the rules or desired.

Referring now to FIG. 2, to play the game, the spinner 210 is activated. The spinner 210 includes two spaces with the numeral 1, one space with "back one space", one space with the numeral 0, one space with the numeral 2 and one space with the numeral 3. Other means of moving may be determined also—such as by dice. So while the spinner 210 is the preferred random number generator for this game, another random number generator may be used. For example, a die or a pair of dice may be used to generate a random number.

Referring again to FIG. 1, LET THERE BE space 240 is to the right of house shaped PEACE! GRACE! 190 and in the center of the board.

Figure 3:
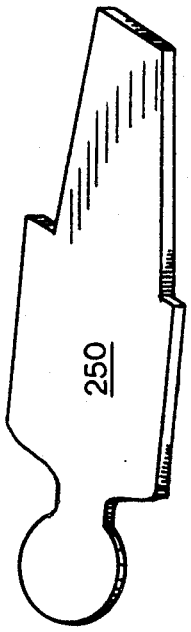
FIG. 3 illustrates a human FIG. 252 capable of fitting into board 100 of the stress-reducing game of this invention.

FIG. 3 depicts a flat human-shaped figure called ME 250. ME 250 fits into ME 252 on board 100. Such structure lends human features to the game and reduces stress.

Figure 4:
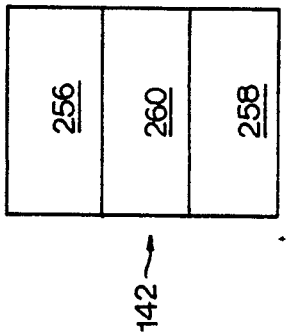
FIG. 4 illustrates a division of desire space 142 divided into three parts.

The three way division of spaces typical of the game is shown by considering FIG. 4, which depicts DESIRE pace 142. DESIRE space 142 has an VOILA section 256 and a lower HEEBIE JEEBIES section 258, center portion 260 therebetween. This is typical of the three division of most of the spaces around the edge of the board.

DIRECTION CARD DATA—84 DIRECTION CARDS

Typical of the direction cards used in this game are directions to various space. A preferred distribution of the cards is as follows.

| | | |
|---|---|---|
| 34 | direct to | "V" . . . Voila |
| 34 | direct to | "HJ" . . . heebie Jeebies |
| 4 | direct to | S Curb |
| 1 | direct to | KARMA |
| 2 | direct to | take another card |
| 2 | direct to | Dream comes true |
| 1 | direct to | get a dream |
| 1 | direct to | go to next space |
| 1 | direct to | go to Assurance |
| 1 | direct to | go to Bondage |
| 1 | direct to | lose a dream |
| 1 | direct to | go to lower half of HALF and HALF |
| 1 | direct to | neutral |
| 84 = | Total | Direction cards |

OTHER DIRECTIONS ALSO ON THE 84 CARDS

Many other directions can appear singly on the cards. These are as follows:

| Type of Directions | Cards |
|---|---|
| Skip a turn | 2 Cards |
| Get another Dream | 7 Cards |
| Dreams come true | 5 Cards |
| Go forward one space | 3 Cards |
| Lose a Dream | 4 Cards |
| Get a chip | 2 Cards |
| Go to Desire | 2 Cards |
| Pick another card | 3 Cards |
| Go forward two spaces | 1 Card |
| Go back one space | 1 Card |
| Go back two spaces | 1 Card |
| Go back to LISTENING | 1 Card. |

Particular appropriate cards are listed below and numbered as indicated for use in the game.

READINGS OF 84 DIRECTION CARDS

Fifty cards are used in each game with the required eight cards indicated by an asterik (*). Where the printing on the direction cards does not comply with the standard rules of the English language, such incorrect language is used for emphasis. The 84 direction cards, with abbreviations are as follows:

PS=Directions and/or comments where token is to land.

v=upper level "VOILA".

HJ=lower level. "HEEBIE JEEBIES".

S="S CURB".

01. Believe nothing and be on your guard about everything. PS. . . Take another card.
02. Riches are not an end to life but an instrument of life. PS. . . .V.
03. All I see teaches me to trust the Creator mor. PS. . . V.
04. If you put all your eggs in one basket. . . WATCH THAT JOKER! PS. . . HJ. . . You fell asleep; also skip a turn.
05. Some times you can learn more from a man's mistakes, than from his goodness. PS. . . you caught on fast. . . Get another dream/idea, also if you had dreams they are now in full bloom.
06. Money is a good working servant, but a bad taskmaster. PS..YOU ARE A SLAvE TO YOUR MONEY. . . give up everything and go to KARMA.
07. With God sail over the seas; without Him don't go over the door sill. PS. . . V.
08. Turn your brain on before you start flapping your lips. PS. . . Blabber mouth, go 2 spaces back to HJ.
09. Your chance came and went; cause you brain was spent! PS. . . your numbers came out in the big lottery—you lost your ticket. Go back to S Curb.
10. God never closes one door without opening another. PS. . . v Select another dream.
11. When God stirs you. . . you glow. . . PS. . . V.
12. Prayers keep the world in tune. . . PS. . . V.
13. Patience and gentleness is power. . . PS. . . V.
14. A friend is a present you give yourself. . . PS..V.
15. Wisdom is only found in truth. . . PS. . . V. Go forward one space.
16. Life is a jigsaw puzzle—with most of the pieces missing. PS. . . HJ..You were looking for peace in love but settled for pieces of money—(with strings). . . Give up your dreams get a Hanker Chip.
17. He who has imagination without learning, has wings but no feet. PS. . . Your imagination has tied you in knots. Go back to S Curb.
18. Nature never deceives us. . . It is always we who deceive ourselves,PS. . . HJ.
19. Ambition is like a wheelbarrow; it stands still until someone pushes it. PS. . . Yours even had cobwebs on it. . . HJ.
20. Failure is the line of least persistence. . . PS. . . HJ.
21. When you are through changing, you are finished . . . PS..HJ.
22. Some days make us happy; some make us wish and others make us wise. PS. . . HJ. . . You made all your days..SAD.
23. Two men looked through prisons bars; one saw a sewer, the other saw stars! PS..V..YOU LOOKED UP!
24. I've had more trouble with myself, than any other person I know. PS. . . V..It's been for your good, you're gaining. . . Get another Dream Idea.
25. We can get anything we want for the price of our labor. . . ,PS..HJ..Your energy was drugged! Give up all your Dreams/Ideas go back to "DESIRE".
26. Through trouble you learn a lesson and a blessin. PS..You're so hard headed, nothing got through; go to S CURB.
27. If you would judge. . . Understand. . . PS..V..Dream comes true for you.
28. Character is what you are when you think no one is looking. PS. . . Get a Dream Give yourself E for Effort; your trying.
29. He who forgives, ends a quarrel. . . PS. . . You forgave. . . V.
30. God gives the birds their food but he doesn't throw it in their nest. . . PS. Stop wishing; get up and get busy..HJ.
31. The hidden side of errors is truth. . . PS..HJ.. You didn't stop talking long enough to check it out.
32. The truest end to life is to know that life never ends. PS..V..You really learning.
33. A wish can be the father of an idea. . . PS..HJ.. Why are you so satisfied with old habits?
34. If a peck of trouble gets you down, Try an ounce of Faith, PS..HJ..pick another card.
35. Not even an army can stop as idea whose time has come! PS. . . You were too doped up to grab the brass ring. . . HJ.
36. The Chance to do wrong comes easy; to do good takes work. PS..Your on the job. . . Your dream comes true..V.
37. Common sense is very uncommon . . . PS..V..you are rare go ahead 2 spaces.
38. No one reaches a high position without daring. . . PS..V..You took a chance.
39. The louder he talks of his honesty, the faster we put up the silver. . . PS. . . HJ..You brag too much.
40. Your ulcer is not due to what you are chewing, but what's chewing you. . . PS..BURP! ! ! You didn't even say excuse me..HJ.
41. If you add a little to a little and do it often, soon the little becomes a Whopper. . . PS..V.
42. If you talk to a man about himself, he listens for hours..PS..HJ You even got mad when they stopped talking. . . give up your dream.
43. Trouble knocked on the door but hearing a laugh within ran away. PS..V.. You had on a happy face.

44. The most earnest prayers are often just a moan. . . PS..V and you didn't even know it until the prayer was answered.
45. Promises are like pie crust; are made to be broken. . . PS. . . HJ..and you even lied! . . . go to S curb.. You'd better change those habits!
46. Two Tragedies in life. . . one is not to get your heart's desire; the other one is to get it. . . PS. . . HJ! You get a car new to you, but old to the last owner.
47. If the cause is good; its worth living up to;. . . PS. . . V. . . you found the strength from somewhere, when you realized "how good it REALLY is."
48. The greatest of faults is to be conscious of none. . . PS. . . HJ..Guilty
49. Change is permanent. . . everything else changes. . . PS. . . Go to the next space, ponder over the above truth then pick another card.
50. Progress is not an accident. PS. . . You worked your plan. Your Dream came true
51. The remedy for hurts is to forget them. . . PS. . . HJ. . . Your anger blew your mind.
52. Habit; if not changed soon becomes a necessity. . . PS. . . Your habit became your worst enemy. Go back one space to . . . HJ.
53. POMPOUS=outright stupidity and naked ignorance! . . . PS. . . HJ. . . How long before you will understand? . . . Give up your dream to the person behind you.
54. Wrong is always wrongest when you're using it for right. . . PS. . . GO back 2 spaces. . . HJ
55. Ideas are tricky little things; they don't work unless you do. . . PS. . . HJ. LAZY. . . What happen to your understanding and will power?
56. Everyone is ignorant; but not always on same topic. . . PS.. You realized that. . . V.
57. Anger always make dull men witty but keeps them poor. . . PS. . . Pick another card.
58. He that wants nothing is always free. . . PS. . . select another card or go to S Curb.
59. He that uses meekness has power. . . PS. . . your Love and Faith is proof of this. . . V.
*60. Always forgive a man for the harm he does, nothing annoys him more. . . PS. . . Reclaim your Dream or get another one. . . V. . . Your Dream has materialized.
*61. I am not now: That which I have been. . . PS..Think about it! ! visit Assurance.
*62. One on God's side is a majority. . . PS. . . Dream comes true. To the next space that has an upper level. . . V.
*63. HEEBIE JEEBIES? . . . BUMPUS of the KUNKUS! . . . PS . . . Give up everything, get a Hanker Chip and go back to Bondage.
*64. When you try to do two things at once, you fail at both. . . PS. . . you tried to do three things at once! ..Get rid of all your dreams and go back to Desire. . . HJ.
*65. All happiness is like perfume; you cannot shower others without getting a few drops on yourself. . . PS. . . If you had no dream; get one. If you have one it comes true. Get another one. . . V.
*66. Faults are many when your love wears out. . . PS..You lost your dream, Give it to the player ahead of you.
*67. Worry two days a week.—Yesterday and tommorrow. . . PS. . . Guess what you did? . . . Go to HALF and HALF. . . Lower half. . . and skip a turn.

(The asterik (*) indicates a stationary card, the presence of which is required for the most preferred form of the game.)

68. Worry is the interest paid by those who borrow trouble. . . PS..Your worried about getting fired. . . Well you didn't; you got an ulcer!
69. Good Humor is a cheerful frame of mind. It enables a teapot to sing with hot water up to its nose. . . PS. . . Glad you knew that..V.
70. Usually he is empty who is full of himself. . . PS. . . HJ.
71. When your through changing, your through. . . PS You never even started. Go back to "LISTENING". . . HJ.
72. Losing is not bitter if you don't swallow it. . . PS. . . You felt sorry for yourself. . . HJ.
73. Worry and fear shared is worry and fear dragged out til bed time. PS. . . HJ.
74. One of my fears: One day someone would ask me to spell Pneumonia. PS. . . I looked it up. . . Can you face your fears?
75. The Lord will provide; but you have to give Him some action. . . PS. . . Use your faith. . . V.
76. When you are able to laugh at yourself, you've grown up. . . PS..YOUR ON TOP.. YOUR OUT OF BONDAGE. . . GO TO PERSONAL GIFTS. . . V.
77. Kindness is the Communication that the blind can see and the deaf can hear. PS. . . V. . . That is the nature of God.
78. Imagination is the air of your thoughts..PS. . . Yours is working overtime. . . V.
79. It's easy to be wise after the event. . . PS..You got stung. . . HJ.
80. Trying to improve oneself is a life time occupation. . . PS. . . V.
81. Even a fool when he holds his peace is considered wise. . . PS. . . Y your learning.
82. He who throws dirt, always loses ground. . . PS. . . Count to ten you're in a hole. . . HJ.
83. If you wish to avoid seeing a fool, break your mirror. . . PS. . . HJ.
84. Let memory be your traveling bag. . . PS. . . go to S Curb.

Other sayings which can also be used for this game are:

Easter Sunday comes with good weather. You look good in your new clothes. A dream comes true. But your new shoes gave your feet the Heebie Jeebies.

If you do not have any other Dream/Idea working, use a Hanker Chip.

If you had no Dreams, go back to "S" Curb.

If you don't have any other Idea/Dream working; use a Hanker Chip.

If you had no Dreams, go back to "S" Curb.

You finally got that car you're been looking at! A Dream/Idea comes true! It's a lemon. Heebie Jeebies! If you do not have another Dream/Idea working, uae a Hanker Chip.

If you had no Dreams, go back to "S" Curb.

You missed the boat! Heebie Jeebies.

You won the big pot in the lottery! ! A Dream comes true! You lost your ticket! Heebie Jeebies. If you don't have another Dream/Idea working, use a Hanker Chip.

If you had no Dreams, go back to "S" Curb.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of disclosure.

Because of this disclosure and solely because of this disclosure, modification of this method and game can become clear to a person having ordinary skill in this particular art. Such modifications are clearly covered by this disclosure.

What is claimed and sought to be protected by Letters Patent of the United States is:

1. A board game for at least two players designed to maximize the development of an idea or dream, wherein:

a. said game includes one playing board;
b. said game includes at least one random number generator;
c. said game includes at least one deck of direction cards;
d. said game includes at least one indicator token to show a position of one player;
e. said game includes blank cards;
f. said game includes a holding mechanism for a deck of cards;
g. said game includes a space indicating success of playing said board game situated in a center portion of said board;
h. said game includes a plurality of edge spaces around said edge thereof;
i. said board includes a center space;
j. at least some of said spaces include at least two parts;
k. said at least two parts include a negative occurrence part and a positive occurrence part;
l. said random number generator and said direction cards combine to serve for moving of a player token around said board;
m. each of said spaces provide various instructions for proceeding with said game; and
n. said game includes a set of eighty-four cards, said set having at least two requird cards and at least thirty additional cards drawn from said set of eighty-four cards to provide variety to said game.

2. The game of claim 1 wherein:

a. said at least two required cards are eight required cards; and
b. said at least thirty additional cards are forty-two additional cards drawn from said set of eighty-four cards.

3. The game of claim 2 wherein:

a. said player token moves around said board pursuant to said random number generator and said direction card; and
b. a second token is used by a player at a special section of said board.

4. The game of claim 3 wherein said board includes at least one special instruction space.

5. The game of claim 4 wherein:

a. a first starting space for said game is entitled bondage; and
b. a second starting space for said game to circumnavigate said board a second time is entitled decisions.

6. The game of claim 5 wherein:

a. said board is rectangular and has a first corner thereof, a second corner thereof, a third corner thereof and a fourth corner;
b. between said first corner and said second corner are a plurality of landing spots for a player token used in said game, said landing spots being entitled sequentially Forgive, Expectations, Life, Prosperity, and I Am; with said landing spot entitled Forgive being closest to said first corner and said landing spot entitled I Am closest to said second corner;
c. between said second corner and said third corner are a plurality of said landing spots for a player token used in said game, said landing spots being entitled sequentially Bondage, Desire, Decision, Power, Love, Faith, Work, Imagination, Habits, and Prayer with said landing spot entitled Bondage being closest to said second corner and said landign spot entitled Habits closest to said third corner;
d. between said third corner and said fourth corner are a plurality of said landings pots for a player token used in said game, said landing spots being entitled sequentially Listen, Assurance, Renunciation, Rest, Meditation with said landing spot entitled Listen being closest to said third corner and said landing spot entitled Meditation being closest to said fourth corner; and
e. between said first corner and said fourth corner are a plurality of said landing spots for a playr token used in said game, said landing spots being entitled sequentially Order, Understanding, Peace, Zeal, Wisdom, Strength, Will, Karma, Nature of God and Feast, with said landing spot entitled Order being closest to said first corner and said landing spot entitled Feast being closest to said fourth corner.

7. The game of claim 6 wherein:

a. said board has a central portion for words to be printed thereon;
b. said board has three spaces for a different deck of cards in said central part; and
c. said board three spaces receive a deck of direction cards, a deck of negative cards and a deck of positive cards.

8. The game of claim 8 wherein:

a. fifty of said direction ards selected from a set of eighty four are used in each play of said game;
b. eight of said direction cards are required for each play of said game; and
b. a selection of said direction cards changes each play of said game.

* * * * *